United States Patent [19]

Wood

[11] 4,004,415

[45] Jan. 25, 1977

[54] PROPELLANT FOR LIQUID PROPELLANT GUN

[75] Inventor: Stanley E. Wood, Inyokern, Calif.

[73] Assignee: The United States of America as represented by the Secretary of the Navy, Washington, D.C.

[22] Filed: Dec. 11, 1974

[21] Appl. No.: 532,534

[52] U.S. Cl. ..... 60/214; 60/211; 89/7; 149/74

[51] Int. Cl.[2] ..... C06D 5/08

[58] Field of Search ..... 89/7; 149/74; 60/211, 60/214

[56] References Cited

UNITED STATES PATENTS

| | | | |
|---|---|---|---|
| 2,088,503 | 7/1937 | Broussard | 89/7 |
| 2,563,532 | 8/1951 | Kistiakowsky | 149/74 X |
| 2,981,153 | 4/1961 | Wilson et al. | 89/7 |
| 3,031,839 | 5/1962 | Larson | 60/214 |
| 3,086,356 | 4/1963 | Craig et al. | 60/214 |
| 3,800,657 | 4/1974 | Broxholm et al. | 89/7 |
| 3,944,448 | 3/1976 | Marlowe | 149/74 X |

*Primary Examiner*—Edward A. Miller

*Attorney, Agent, or Firm*—R. S. Sciascia; Roy Miller; L. E. K. Pohl

[57] ABSTRACT

Nitric acid and n-octane are injected into a gun and utilized to propel projectiles.

3 Claims, No Drawings

PROPELLANT FOR LIQUID PROPELLANT GUN

BACKGROUND OF THE INVENTION

1. Field of the Invention

This invention relates to propellants for liquid propellant guns.

2. Description of the Prior Art

The military is, at the present time, experimenting with what are commonly called liquid propellant guns or, still more commonly, LPG's. A liquid propellant gun (LPG) is one which utilizes, instead of the usual solid powder and primer propulsion means, a liquid propulsion means. The potential advantages of such a gun over presently used guns are many. One advantage is that brass cartridges are not used. This eliminates storage and policing up problems. Another advantage resides in the probability that greater muzzle velocities can be achieved with LPG's than are presently possible with conventional guns. Still other potential advantages exist. However, this invention resides in a propellant for a liquid propellant gun and not in a liquid propellant gun per se so these further potential advantages will not be gone into here.

One method for firing a liquid propellant gun is to inject two liquid chemical components into a chamber behind the projectile and apply a spark to cause the two liquid components to combust and produce gases which, in turn, propel the projectile. (This, with the exception that both components are liquids, is very similar to the way in which an automobile is propelled by injecting gasoline and air and subjecting them to a spark behind a piston.)

When two liquids are injected to fire a LPG, they are injected from separate containers into the gun chamber. When they come together, in the gun chamber, they must not react spontaneously. That is, they must mix and wait until a spark is applied before reacting.

SUMMARY OF THE INVENTION

It has been found that red fuming nitric acid and various solutions of nitric acid and water in combination with n-octane can be utilized as propellants for liquid propellant guns. A nitric acid component and a n-octane component may be simultaneously injected into a gun chamber and ignited by means of a spark but do not react spontaneously (without sparking).

DESCRIPTION OF THE PREFERRED EMBODIMENTS

The term nitric acid component may be taken, insofar as this invention is concerned, to mean red fuming nitric acid or nitric acid-water solution containing nitric acid in the range of from 98 to 82 weight percent and, correspondingly, water in the range of from 2 to 18 Weight percent. Red fuming nitric acid is nitric acid which contains dissolved nitrogen dioxide and a small amount of water (about 1 to 2 weight percent). According to this invention, the nitric acid components, whether it be red fuming nitric acid or a nitric acid-water solution encompassed by the above weight percentage ranges, may contain on the order of 1 weight percent of hydrofluoric acid. Hydrofluoric acid is a corrosion inhibitor. Experiments have shown that the nitric acid component works equally well with or without it.

The fuel, according to this invention is n-octane. In many test shots, both with experimental single shot liquid propellant guns and with experimental multi-shot liquid propellant guns, it has been demonstrated that a nitric acid component and n-octane may be safely simultaneously injected, from separate containers, into a gun chamber and ignited by means of a spark. By the term safely, it is meant that a nitric acid component and n-octane will not react spontaneously, i.e., without means of a spark, when they are simultaneously injected into a gun chamber.

Test shots have been conducted with as many as five parts by volume of the nitric acid component to one part by volume of n-octane to as few as two parts by volume of the nitric acid component to one part by volume of n-octane; all with good results. The preferred volume to volume ratio appears to be on the order of four parts of the nitric acid component to one part n-octane.

Going once again to the nitric acid component, the preferred component is one which has from about 90 weight percent nitric acid and about 10 weight percent water to about 82 weight percent nitric acid and about 18 weight percent water. The reason for this preference is that nitric acid-water solutions in this weight percentage range have a longer shelf life than do those with higher weight percentages of nitric acid.

What is claimed is:

1. In a method for propelling a projectile from a gun wherein two liquid chemical components are injected into a chamber behind the projectile and spark ignited to produce gases which propel the projectile, the improvement residing in utilizing, as one of the components, n-octane and, as the other component, a nitric acid component selected from the group consisting of red fuming nitric acid and nitric acid-water solutions containing from 98 to 82 weight percent nitric acid and 2 to 18 weight percent water.

2. A method according to claim 1 wherein about 2 to about 5 parts by volume of the nitric acid component are injected for every 1 part by volume of n-octane.

3. A method according to claim 2 wherein the nitric acid component contains, additionally, about 1 weight percent hydrofluoric acid.

* * * * *